US006926087B1

(12) United States Patent
Henke et al.

(10) Patent No.: US 6,926,087 B1
(45) Date of Patent: Aug. 9, 2005

(54) ELECTRO-MECHANICAL WIRELINE ANCHORING SYSTEM AND METHOD

(75) Inventors: Joseph A. Henke, Lewisville, TX (US); David S. Wesson, Fort Worth, TX (US); Phil Phelps, Fort Worth, TX (US); David M. O'Connor, Aledo, TX (US)

(73) Assignee: Owen Oil Tools LP, Houston, TX (US)

( * ) Notice: Subject to any disclaimer, the term of this patent is extended or adjusted under 35 U.S.C. 154(b) by 0 days.

(21) Appl. No.: 09/677,729

(22) Filed: Oct. 2, 2000

(51) Int. Cl.[7] ..... E21B 23/14

(52) U.S. Cl. ..... 166/382; 166/55.2; 166/66.4; 166/217

(58) Field of Search ..... 166/381, 382, 166/55, 55.2, 66, 66.4, 206, 217, 297, 55.1; 175/4.52

(56) References Cited

U.S. PATENT DOCUMENTS

| | | | | |
|---|---|---|---|---|
| 3,677,080 A | * | 7/1972 | Hallmark | 166/100 |
| 3,686,943 A | | 8/1972 | Smith | |
| 4,375,834 A | * | 3/1983 | Trott | 166/297 |
| 4,429,741 A | | 2/1984 | Hyland | |
| 5,184,676 A | | 2/1993 | Graham et al. | |
| 5,228,507 A | | 7/1993 | Obrejanu et al. | 166/98 |
| 5,303,776 A | * | 4/1994 | Ryan | 166/361 |
| 5,370,186 A | | 12/1994 | Ireland | |
| 5,431,230 A | | 7/1995 | Land et al. | |
| 5,954,131 A | | 9/1999 | Sallwasser | |
| 6,315,043 B1 | * | 11/2001 | Farrant et al. | 166/297 |

* cited by examiner

*Primary Examiner*—David Bagnell
*Assistant Examiner*—Matthew J. Smith
(74) *Attorney, Agent, or Firm*—Madan Mossman & Sriram, P.C.

(57) ABSTRACT

An electro-mechanical wireline assembly as shown for anchoring a wireline tool string in place during a wellbore under balanced well conditions. The assembly includes an upper connection for connection to the wireline leading to the well surface and a lower connector for engaging a wireline tool. An outer mandrel is attached to the lower connector. An inner mandrel is carried at least partly within the outer mandrel and is capable of axial movement within the outer mandrel. A slip gripping assembly is carried on the outer mandrel and includes slips which are normally biased radially inward but which can be moved radially outward for engaging a surrounding wellbore and holding the wireline tool string in place. An electric motor assembly is carried on the wireline assembly between the upper and lower connectors. The electric motor assembly is actuable by an electric current supplied from the well surface through the wireline to effect axial movement of the inner mandrel relative to the outer mandrel to expand the gripping slips in a radial direction between a start position and a set position. The electric motor assembly can be switched in order to reverse the direction of axial movement of the inner mandrel relative to the outer mandrel to retract the gripping slips and return the slips to the start position. A back-up manual release means is provided for manually retracting the gripping slips radially inward upon completion of wellbore operations.

16 Claims, 21 Drawing Sheets

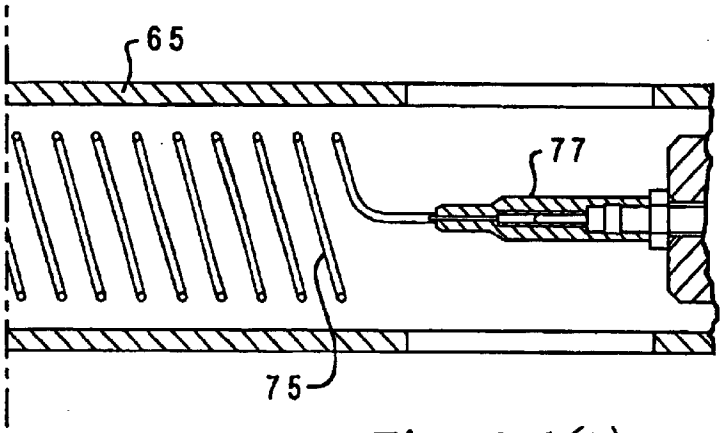
Fig. 2A(2)
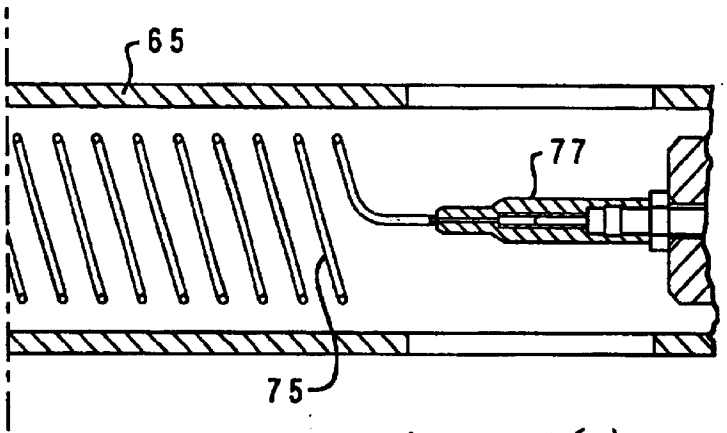
Fig. 1A(2)

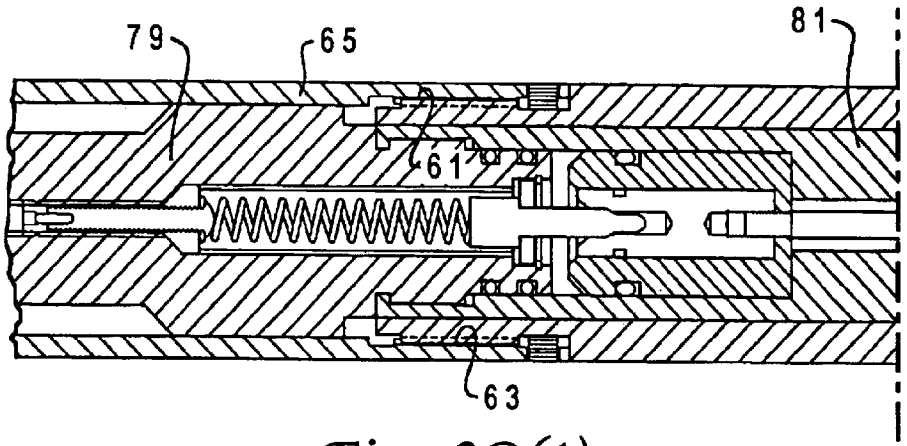
Fig. 2B(1)
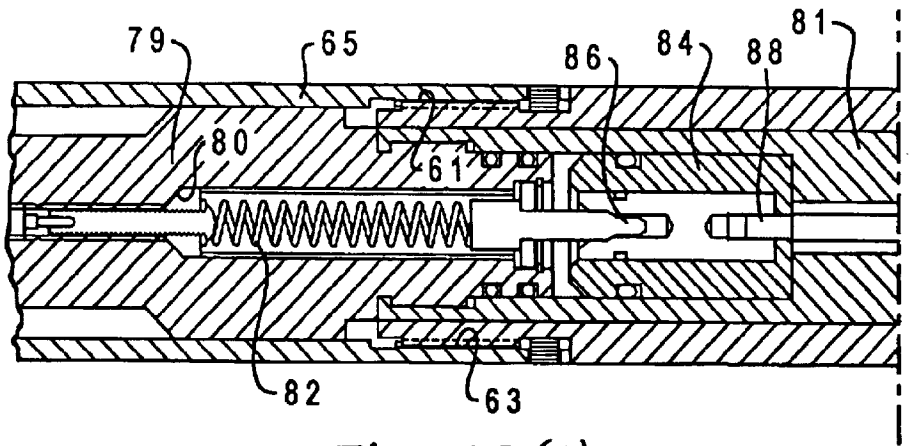
Fig. 1B(1)
Fig. 2B
| Fig. 2B(1) |
|---|
| Fig. 2B(2) |
Fig. 1B
| Fig. 1B(1) |
|---|
| Fig. 1B(2) |

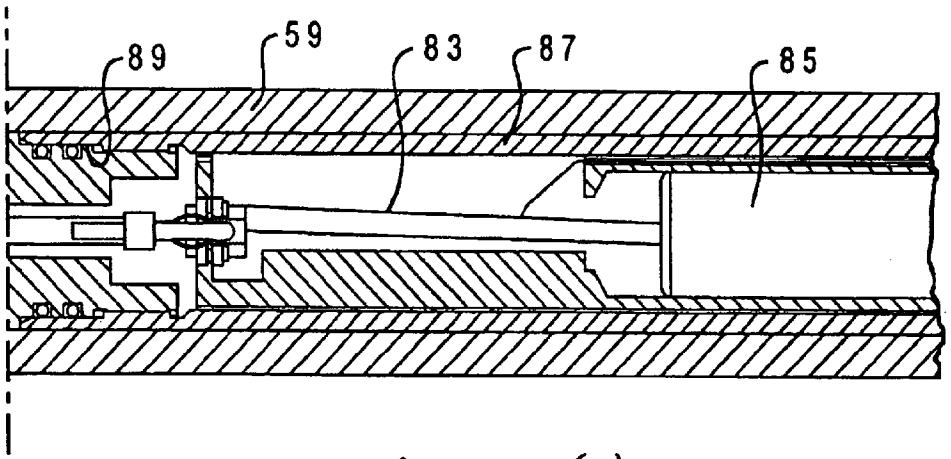
Fig. 2B(2)
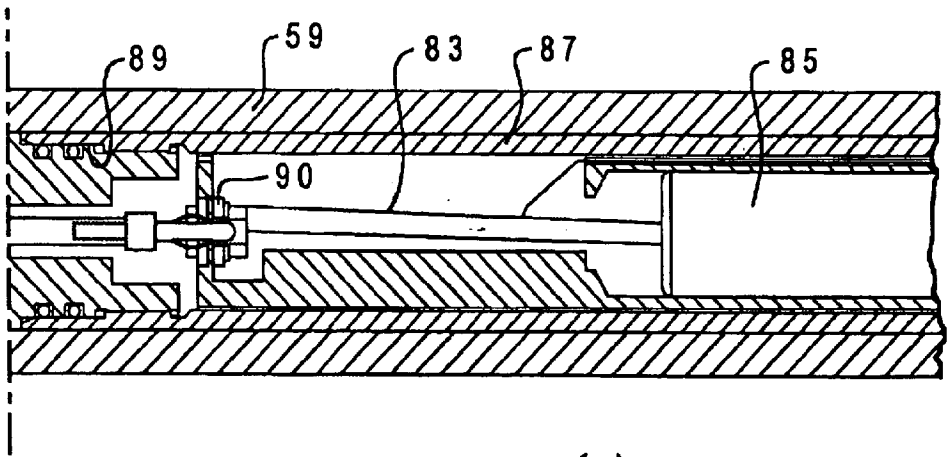
Fig. 1B(2)

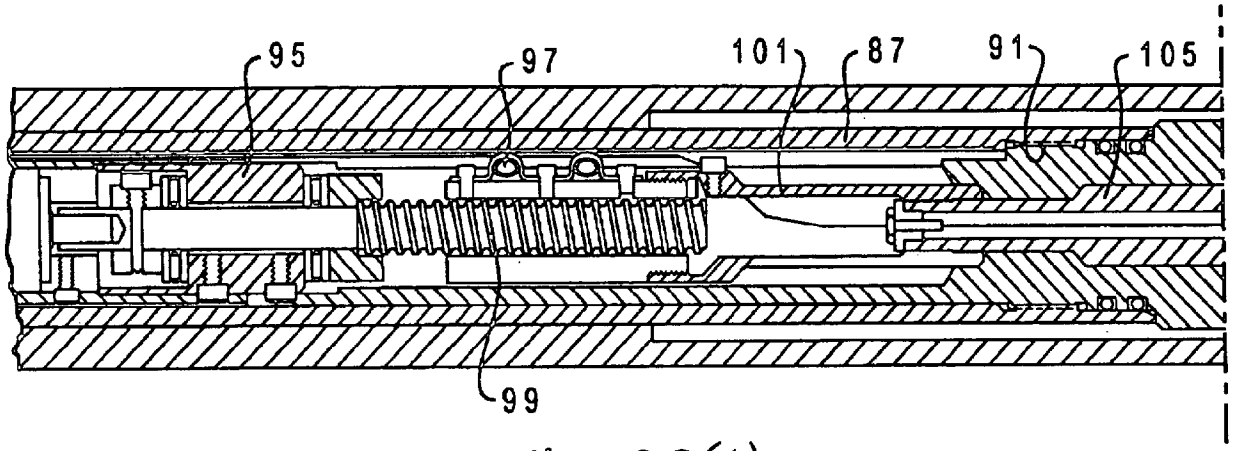
Fig. 2C(1)
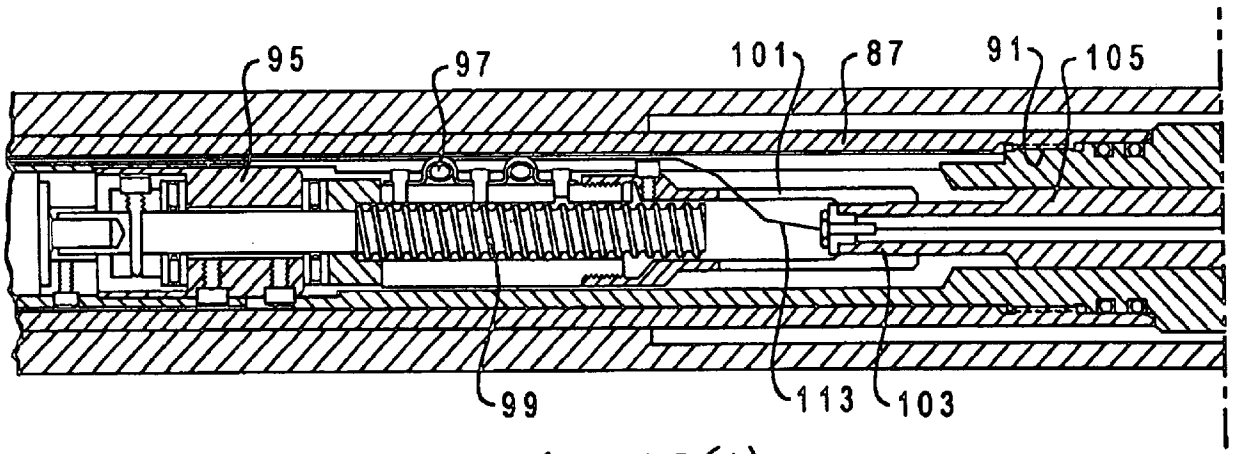
Fig. 1C(1)
Fig. 2B
| Fig. 2B(1) |
| --- |
| Fig. 2B(2) |
Fig. 1B
| Fig. 1B(1) |
| --- |
| Fig. 1B(2) |

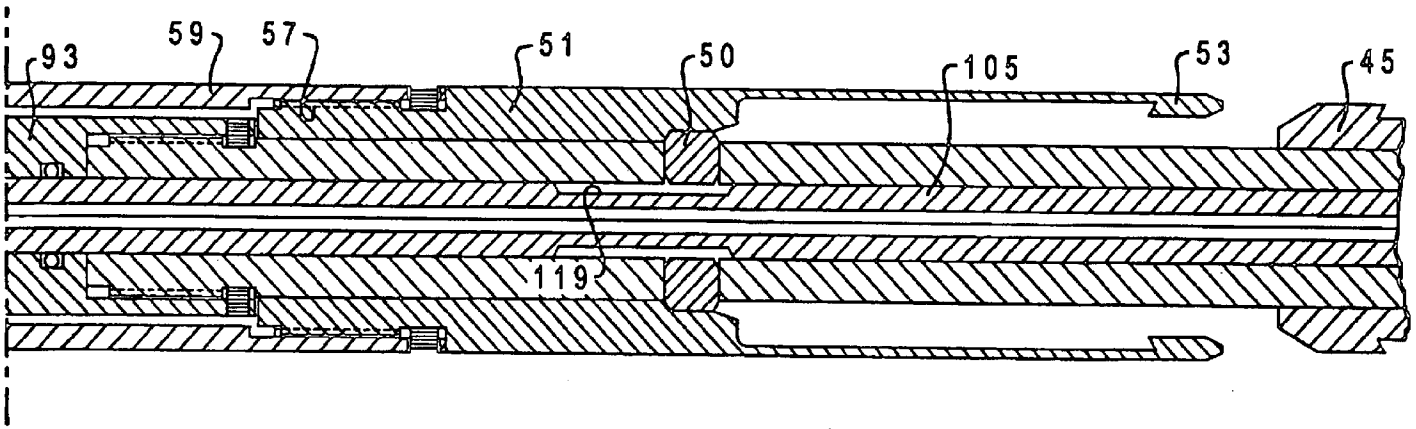
Fig. 2C(2)
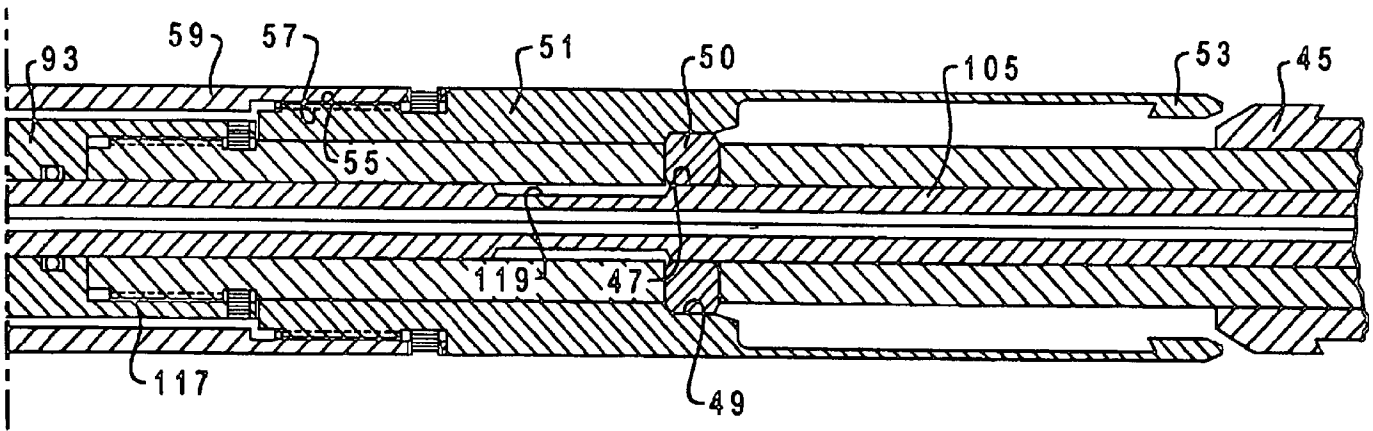
Fig. 1C(2)

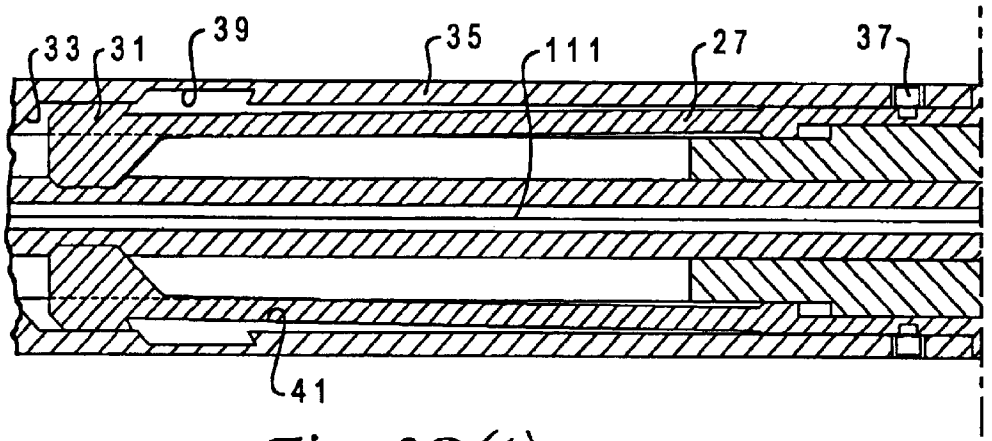
Fig. 2D(1)
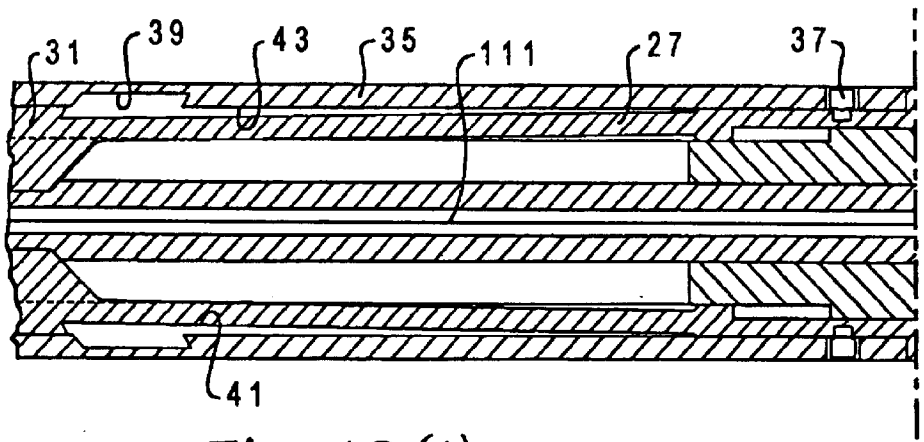
Fig. 1D(1)
Fig. 2D
| Fig. 2D(1) |
| --- |
| Fig. 2D(2) |
Fig. 1D
| Fig. 1D(1) |
| --- |
| Fig. 1D(2) |

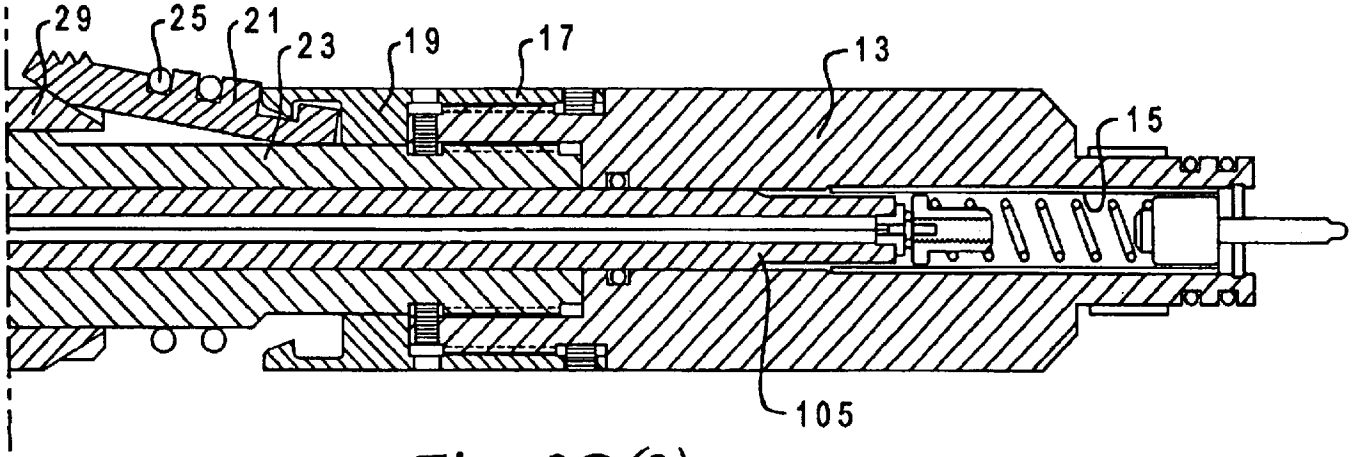
Fig. 2D(2)
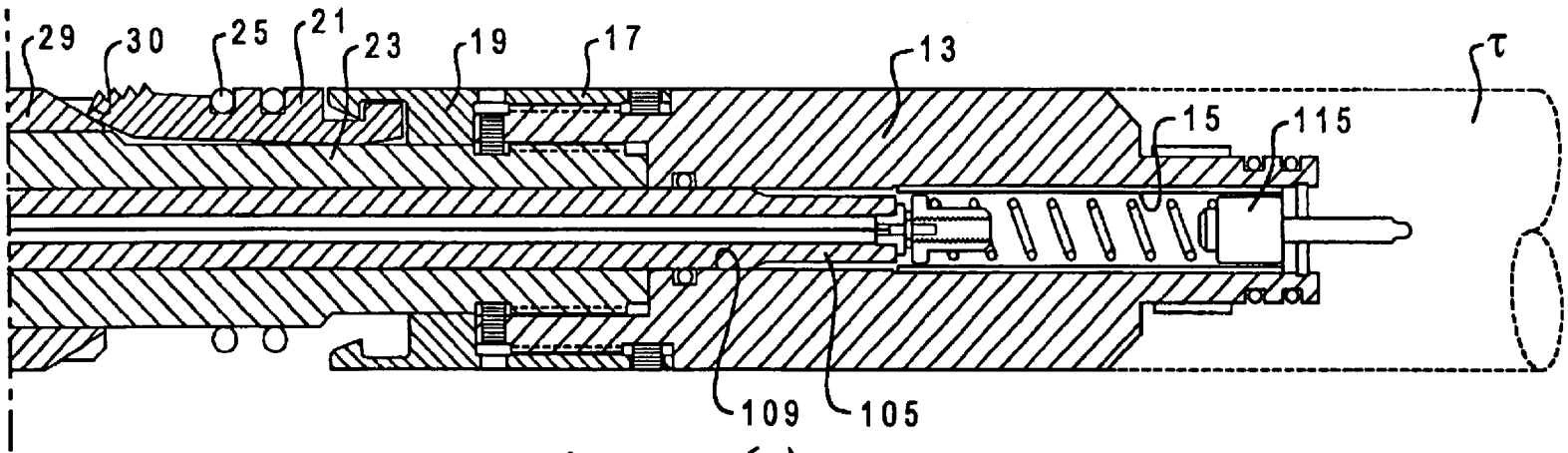
Fig. 1D(2)

Fig. 4A(1)

| Fig. 4A(1) |
| --- |
| Fig. 4A(2) |

Fig. 3A(1)

| Fig. 3A(1) |
| --- |
| Fig. 3A(2) |

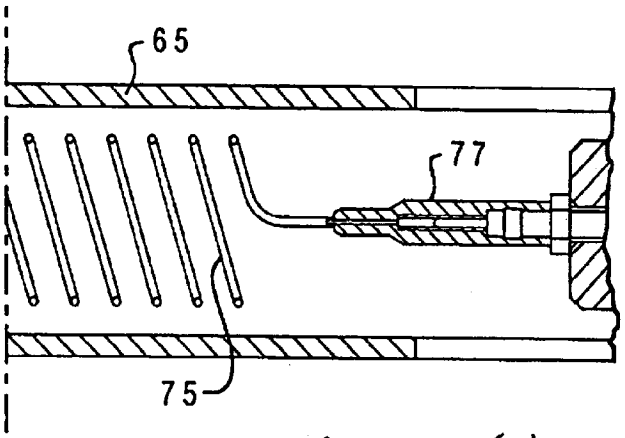
Fig. 4A(2)
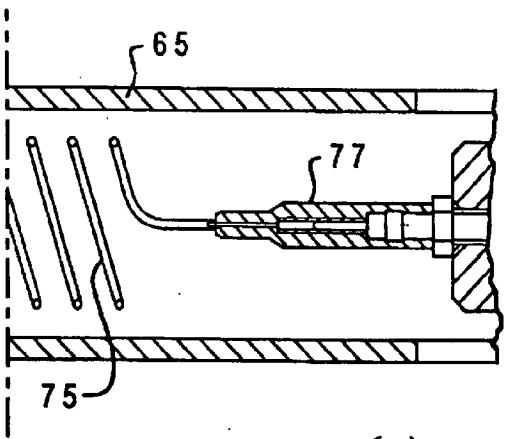
Fig. 3A(2)

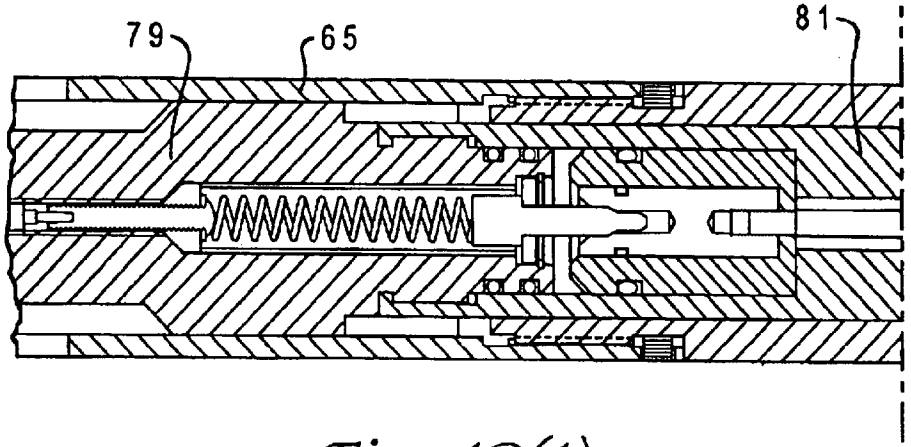
Fig. 4B(1)
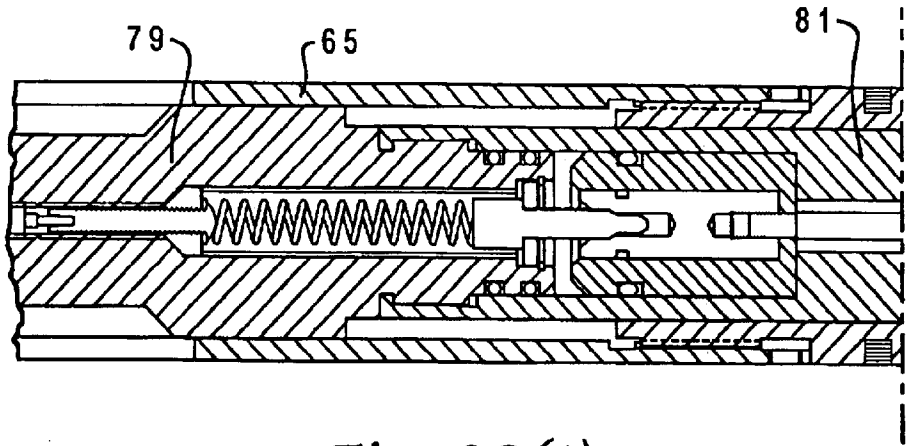
Fig. 3B(1)
Fig. 4B
| Fig. 4B(1) |
| --- |
| Fig. 4B(2) |
Fig. 3B
| Fig. 3B(1) |
| --- |
| Fig. 3B(2) |

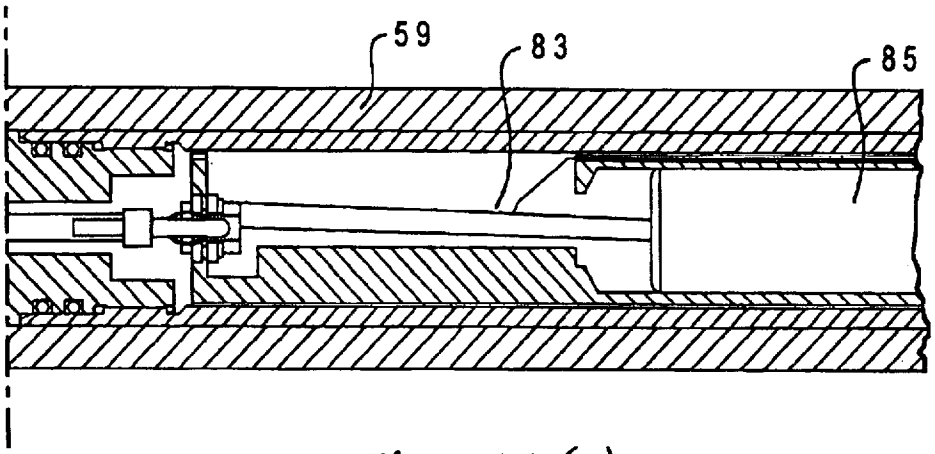
Fig. 4B(2)
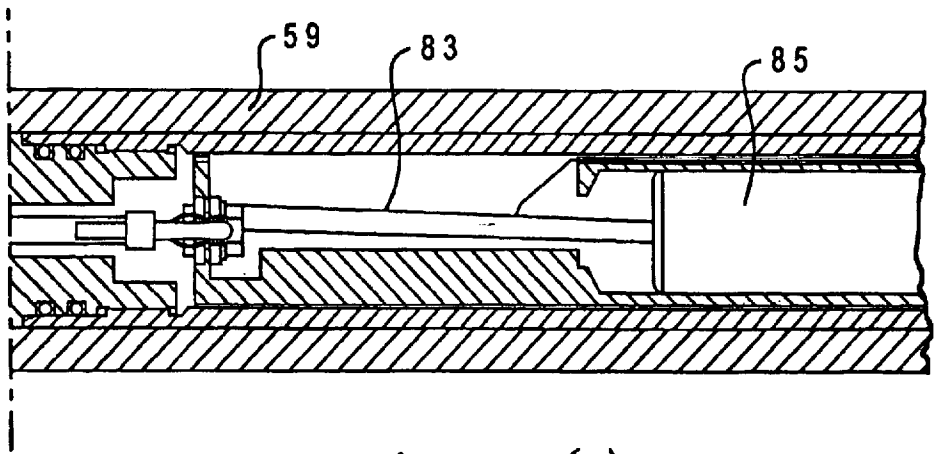
Fig. 3B(2)

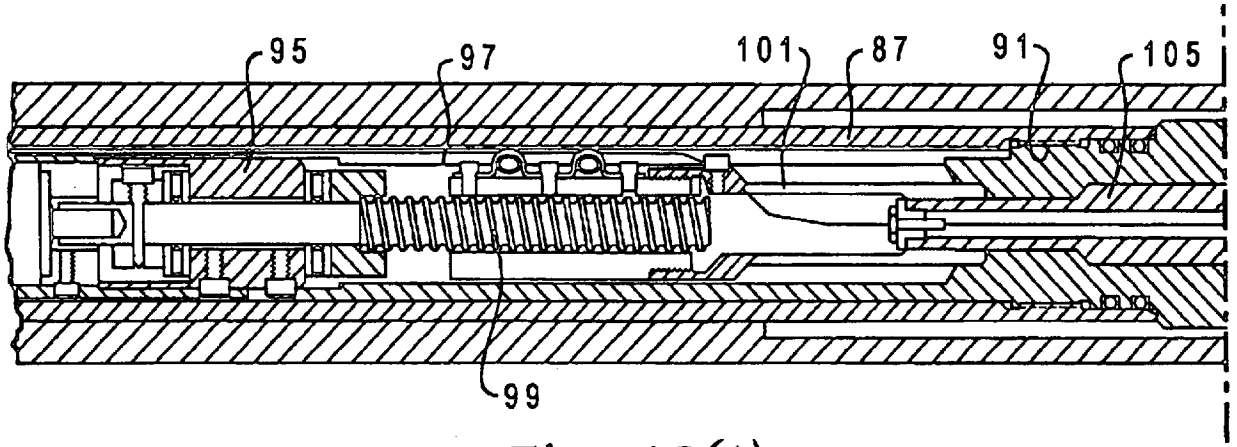
Fig. 4C(1)
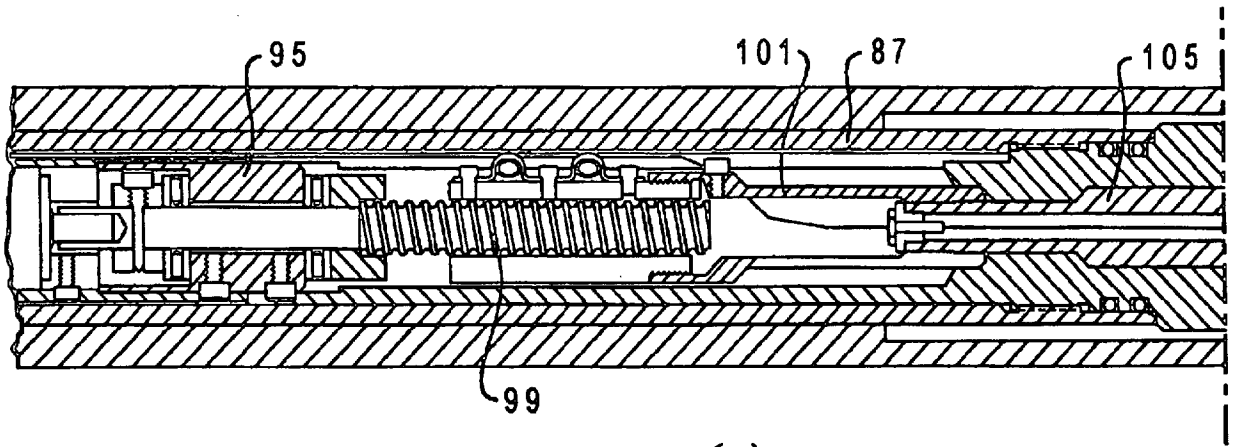
Fig. 3C(1)
Fig. 4C
| Fig. 4C(1) |
| --- |
| Fig. 4C(2) |
Fig. 3C
| Fig. 3C(1) |
| --- |
| Fig. 3C(2) |

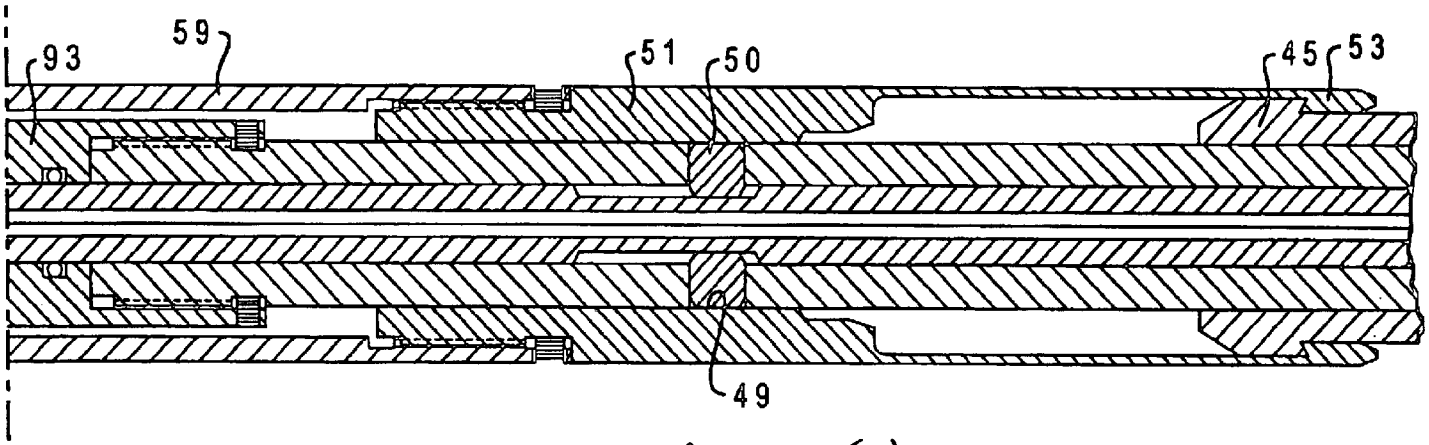
Fig. 4C(2)
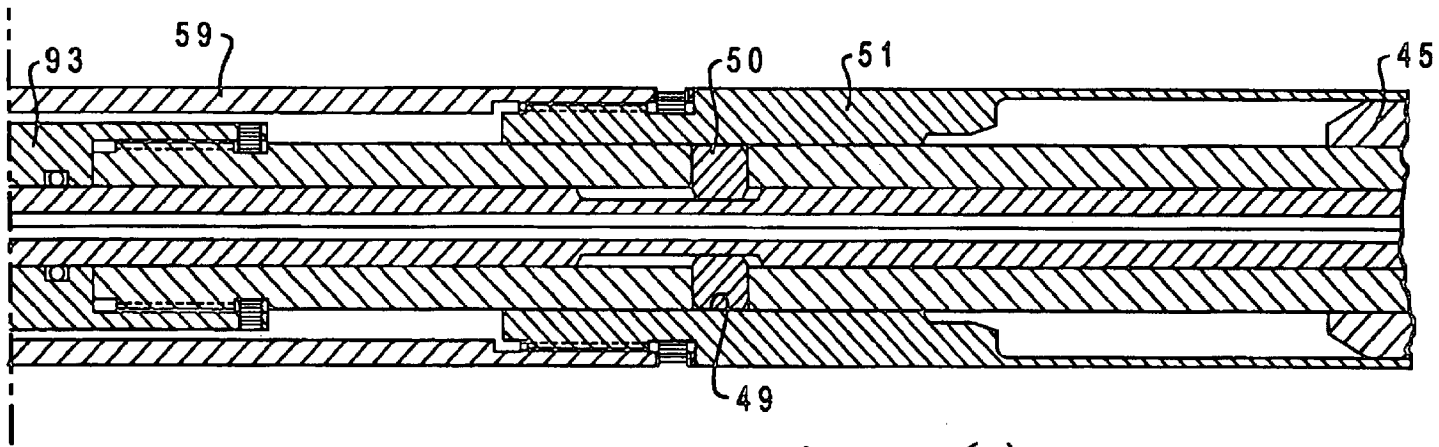
Fig. 3C(2)

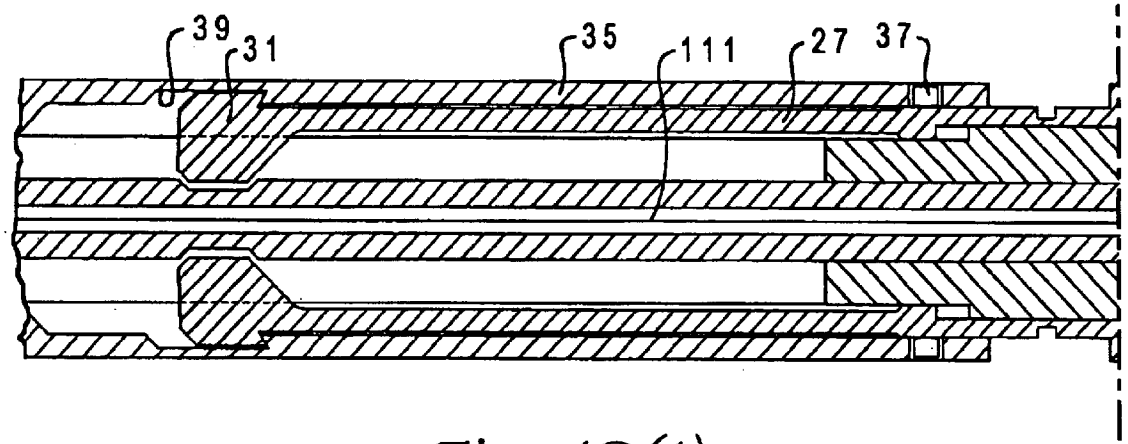
Fig. 4D(1)
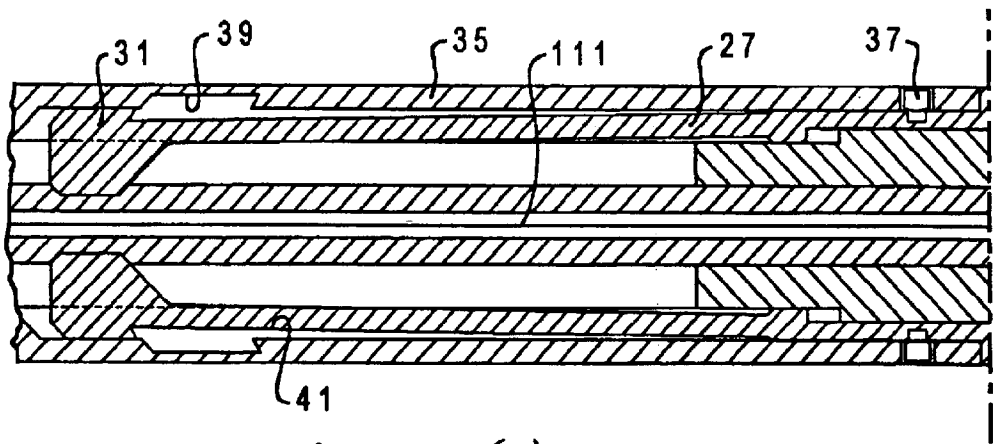
Fig. 3D(1)
Fig. 2D
| Fig. 2D(1) |
| --- |
| Fig. 2D(2) |
Fig. 3D
| Fig. 3D(1) |
| --- |
| Fig. 3D(2) |

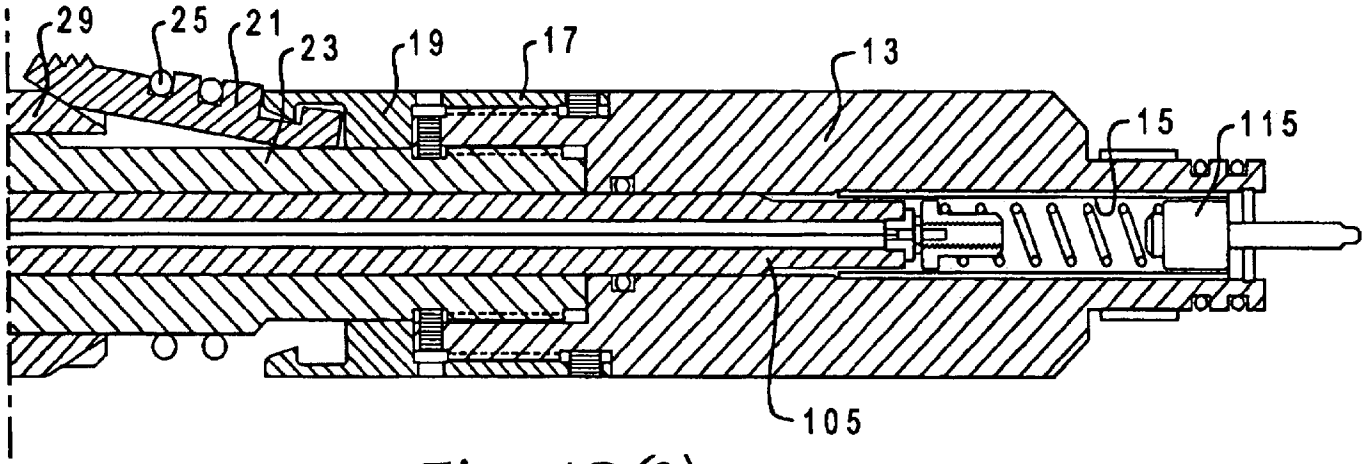
Fig. 4D(2)
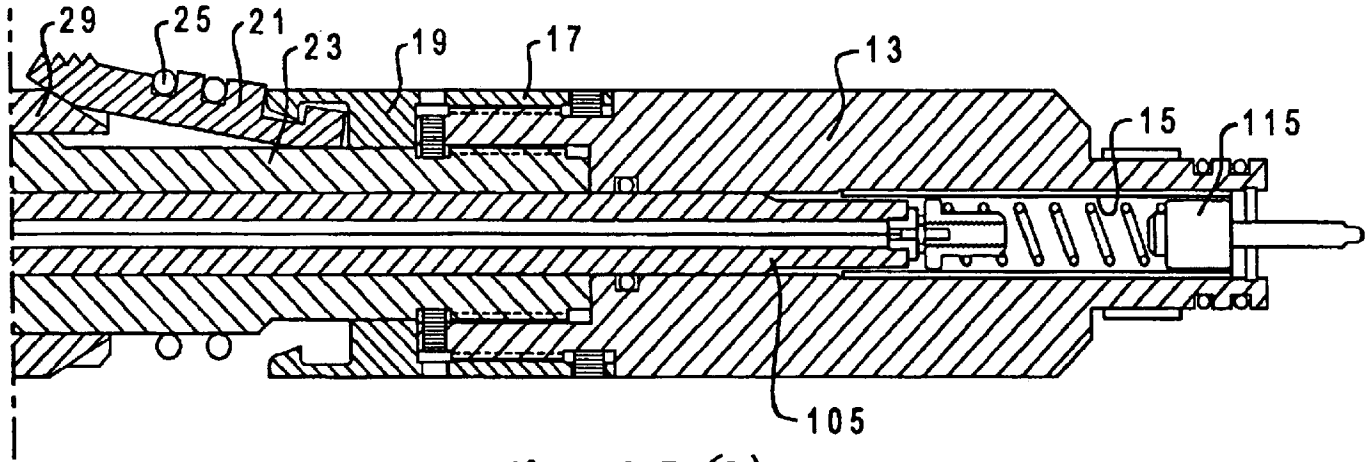
Fig. 3D(2)

| Fig. 5A(1) |
| --- |
| Fig. 5A(2) |

| Fig. 5B(1) |
| --- |
| Fig. 5B(2) |

| Fig. 5C(1) |
|---|
| Fig. 5C(2) |

| Fig. 5D(1) |
| --- |
| Fig. 5D(2) |

ELECTRO-MECHANICAL WIRELINE ANCHORING SYSTEM AND METHOD

BACKGROUND OF THE INVENTION

1. Field of the Invention:

The present invention relates generally to wireline assemblies used in wellbore operations and, specifically to an electro-mechanical anchoring system for a wireline tool string.

2. Description of the Prior Art:

During the production of hydrocarbons from subterranean well formations, a casing string is typically cemented in order to consolidate the wellbore. Typically, a tubing string extends from the well surface to the required depth in the wellbore in order to flow hydrocarbon fluids from the subterranean formation to the surface.

A perforating gun assembly is lowered from the surface and positioned within the casing adjacent the producing interval. The gun may be run on a tubing string or may be suspended from a wireline from the surface. In the case of the wireline tool, an electrical current transmitted through the wireline can be used to actuate the perforating guns in order to perforate the surrounding well casing and allow the flow of fluids to the well surface.

In certain types of wellbore conditions, it may be necessary to provide additional means for holding the wireline tool string in place downhole during underbalanced perforating and/or flowing of the well after perforating.

While various mechanical devices have been utilized in the prior art, most were overly complicated and were sometimes less than reliable in operation.

A need exists for an apparatus to provide a means for holding a wireline tool string in place downhole during underbalanced wellbore operations.

A need also exists for such a device which can be electro-mechanically actuated and which also features a back-up manual release.

A need exists for such a device which will positively indicate when the "set" position has been achieved.

A need also exists for such a device which is simple in design and relatively economical to manufacture.

SUMMARY OF THE INVENTION

The foregoing needs are met with the electro-mechanical wireline assembly of the invention. The electro-mechanical wireline assembly of the invention is used for anchoring a wireline tool string in place in a wellbore, for example, during underbalanced well conditions. The wireline assembly of the invention allows a wireline tool string to be used in the presence of much higher underbalanced wellbore conditions than currently possible when perforating or flowing the well for production information.

The electro-mechanical assembly of the invention is designed to be set by supplying electrical power to an electric motor assembly which forces a slip guide beneath gripping slips to force the slips radially outward into contact with a surrounding casing/tubing wall. Tension can then pulled on the wireline cable connected to the assembly in order to insure that the system is in the set position. Once confirmation is received that the assembly is set, the perforating guns included as a part of the assembly can be fired and the well flowed.

After flowing the well and stabilizing the pressure in the wellbore, the wireline assembly is unset by again supplying power to the electric motor to reverse the setting motion and remove the slip guides from beneath the gripping slips. If, for some reason, electrical power cannot be supplied to the electric motor after the perforating step, then a back-up mechanical release mechanism is utilized to release the wireline assembly mechanically.

The back-up release mechanism is actuated by slacking off tension on the wireline to telescope the tool downwardly within itself. The downward telescoping action engages collet fingers with a releasing neck on a collet latch sub provided as a part of the assembly. An upward pull on the wireline cable then shears one or more shear pins and allows the back-up release mechanism to release the tool as tension continues to be applied upwardly.

In a preferred embodiment, the electro-mechanical wireline assembly of the invention includes an upper connecting means for connecting the assembly to a wireline leading to the well surface. A lower connecting means is provided for engaging a wireline tool such as a perforating gun assembly. An outer mandrel is connected to the lower connecting means. An inner mandrel is carried at least partly within the outer mandrel and is capable of axial movement relative thereto. A slip gripping assembly is carried on the outer mandrel and includes a plurality of gripping slips normally biased radially inward but movable radially outward for engaging a surrounding wellbore and holding a wireline tool string in place in the wellbore.

An electric motor assembly is carried on the wireline assembly between the upper connecting means and the lower connecting means. The electric motor assembly is actuable by an electric current supplied from the well surface through the wireline to effect axial movement of the inner mandrel relative to the outer mandrel to expand the gripping slips in a radial direction between a start position and a set position. Switch means, included as a part of the electric motor assembly, are provided to reverse the direction of axial movement of the inner mandrel relative to the outer mandrel to retract the gripping slips and return the slips to the start position. Preferably, the assembly further comprises a back-up manual release means for manually retracting the gripping slips radially inward upon completion of wellbore operations.

Additional objects, features and advantages will be apparent in the written description which follows.

DESCRIPTION OF THE DRAWINGS

FIGS. 1A–1D are successive portions of a sectional view of the electro-mechanical wireline assembly of the invention in the running-in position and with a wireline tool assembly being shown attached thereto in dotted lines;

FIGS. 2A–2D are successive portions of a sectional view similar to FIGS. 1A–1D but showing the wireline assembly of the invention in the set position;

FIGS. 3A–3D, 4A–4D and 5A–5D are similar successive sectional views but showing the various steps involved in the mechanical back-up release operation.

DETAILED DESCRIPTION OF THE INVENTION

Figure 2A:
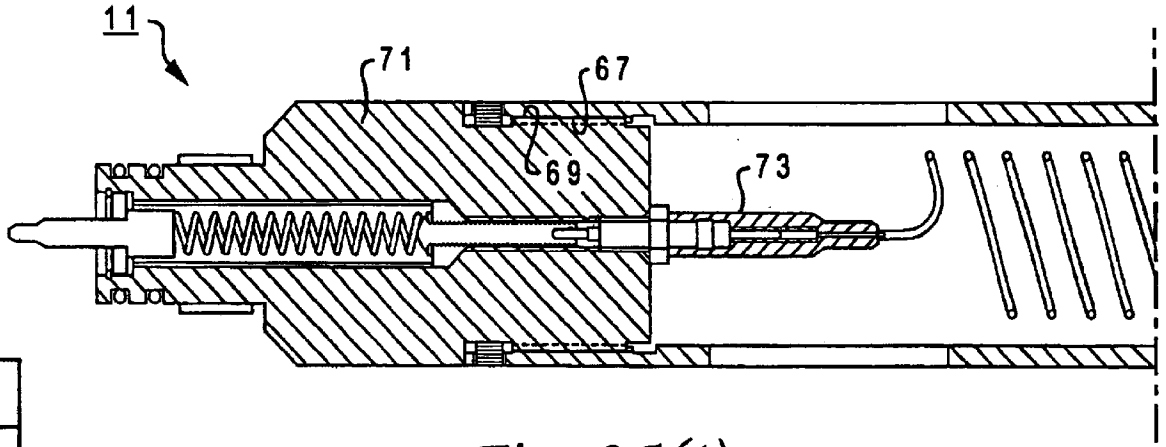

Turning first to FIGS. 1A–1D, there is shown an electro-mechanical wireline assembly of the invention designated generally as 11. The assembly 11 is used for anchoring a wireline tool (shown in dotted lines as "T" in FIG. 1D) in place in a wellbore when conditions warrant, such as during underbalanced well conditions. The wireline tool string "T" could comprise, for example, a well perforating gun string of the type known in the art or a logging string for production logging of the flowing well. The assembly includes a lower connecting means, such as the lower adapter 13 (FIG. 1D) for connection to the wireline tool string which depends downwardly therefrom. The lower adapter 13 is a generally cylindrical body having an internal bore 15 and an externally threaded upper extent 17. A slip gripping assembly 19 carrying a plurality of gripping slips 21 threadedly engages the threaded extent 17 of the lower adapter 13. The slip gripping assembly 19 and gripping slips 21 surround an outer mandrel 23. The gripping slips 21 are pivotable outward between the running-in or start position shown in FIG. 1D and the set or gripping position shown in FIG. 2D. The gripping slips are initially biased inwardly by means of the coiled springs 25 which circumscribe the assembly. Preferably, three gripping slips 21 are circumferentially spaced approximately 120° apart on the exterior surface of the outer mandrel.

As shown in FIG. 1D, a tubular slip guide 27 is carried about the outer mandrel 23 and has a tapered lower extent 29 which functions as a ramp or spreader surface for contacting a mating tapered surface 30 of each gripping slip 21. The slip guide 27 terminates upwardly in a series of collet fingers 31 (see FIG. 2D) which are initially retained in a running-in position by an interior surface 33 (FIG. 2D) of a collet latch housing 35. The collet latch housing 35 is a tubular member which is initially connected to the slip guide 27 by a temporary connecting means such as a plurality of shear pins 37. The collet latch housing 35 also has an internal profile 39 for receiving the slip guide collet fingers 31 upon upward axial movement of the collet latch housing 35. As also seen in FIG. 1D, the collet fingers 31 of the slip guide 27 are located within mating slots 41–43 machined in the exterior surface of the outer mandrel 23. The collet latch housing 35 terminates upwardly in an outwardly tapered fishing neck region 45 (FIG. 1C).

The outer mandrel 23 has a series of window openings 47 for receiving a retaining means such as retaining dogs 50. Other retaining means such as a plurality of retaining balls could also be utilized. The retaining dogs 50 initially prevent downward axial movement of a tubular collet housing 51. The tubular collet housing 51 terminates at a lower extent in collet fingers 53 which are engageable upon downward axial movement with the fishing neck 45 of the collet latch housing 35.

The collet housing 51 has an externally threaded upper extent 55 for engaging a mating internally threaded surface 57 of an outer motor housing 59. The outer motor housing 59 is a generally tubular body having an externally threaded upper extent 61 (FIG. 1B) which threadedly engages the internally threaded surface 63 of a coiled wire housing 65. The coiled wire housing 65 is, in turn, a generally tubular body having an internally threaded extent 67 (FIG. 1A) for threadedly engaging the lower extent 69 of a top adapter member 71. The top adapter 71, as well as certain of the other components of the firing assembly are commercially available from Owen Oil Tools of Fort Worth, Tex., and will be familiar to those skilled in the relevant arts. A wireline collar locator assembly (not shown) would typically be attached to the top adapter 71. A conventional electrical lead in 73 is in electrical contact through the wireline leading to the well surface and to a suitable power supply located at the surface. The lead in 73 (FIG. 1A) has a length of coiled wire 75 located within the tubular housing 65, the coils, being of sufficient length to allow a degree of axial movement of the internal components of the wireline assembly, as will be explained further.

The coiled wire 75 is connected by means of a conventional lead-in 77 to a connecting assembly including the upper portion 79 and lower portion 81. The upper portion 79 has a bore 80 containing contact spring (FIG. 1B). Bushing 84 connects the opposing ends 86, 88 of the conductors which allow the follow up electrical current to the terminal 90. Terminal 90 is connected by means of an electrical lead 83 with an electric motor assembly 85 located within tubular member 87. The tubular member 87 is threadedly connected at an upper extent 89 to the lower portion 81 of the connecting assembly and at the lower extent 91 (FIG. 1C) thereof to a motor frame 93.

The application of an electrical current to the motor assembly 85 acts through bearing assembly 95 and ball nut assembly 97 to turn screw 99. The externally threaded screw 99 connects through a ball nut adapter 101 to an upper extent 103 of an inner mandrel 105. The inner mandrel 105 passes through mating bores in the motor frame 93 and outer mandrel 23 and terminates at a lower extent 107 (FIG. 1D) which is received within a mating bore 109 provided in the lower adapter 13. The inner mandrel 105 also has an internal bore 111 which allows an electrical lead 113 to pass through the interior of the inner mandrel to the bore 15 of the lower adapter 13. A plug assembly 115 is provided of conventional design for electrical connection to a depending wireline tool, such as a perforating gun string (shown in dotted lines in FIG. 1D.)

Figure 1A:
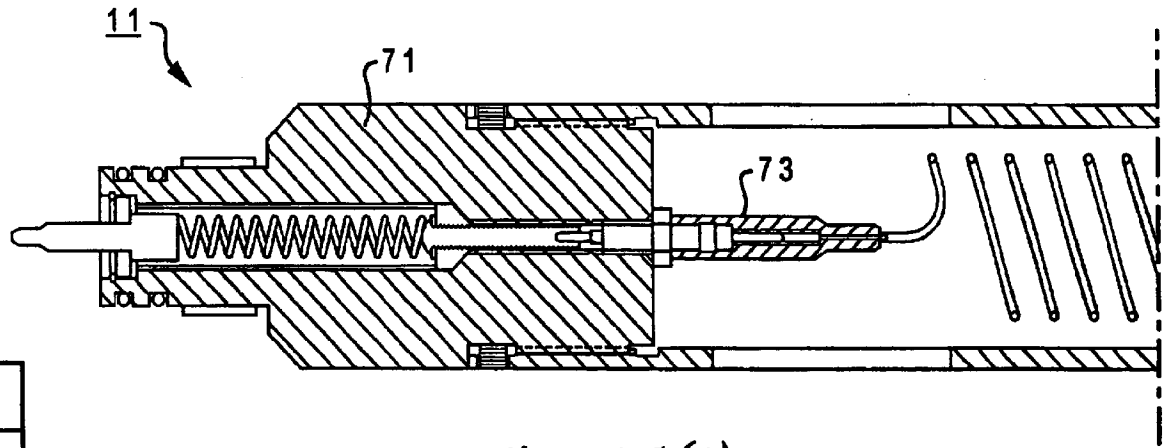
Figure 4A:
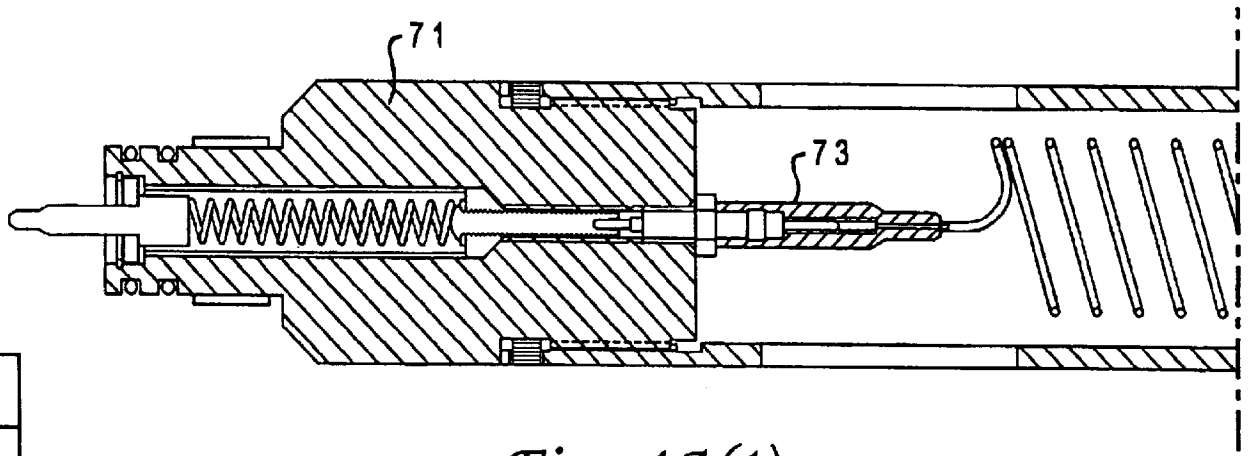
Figure 3A:
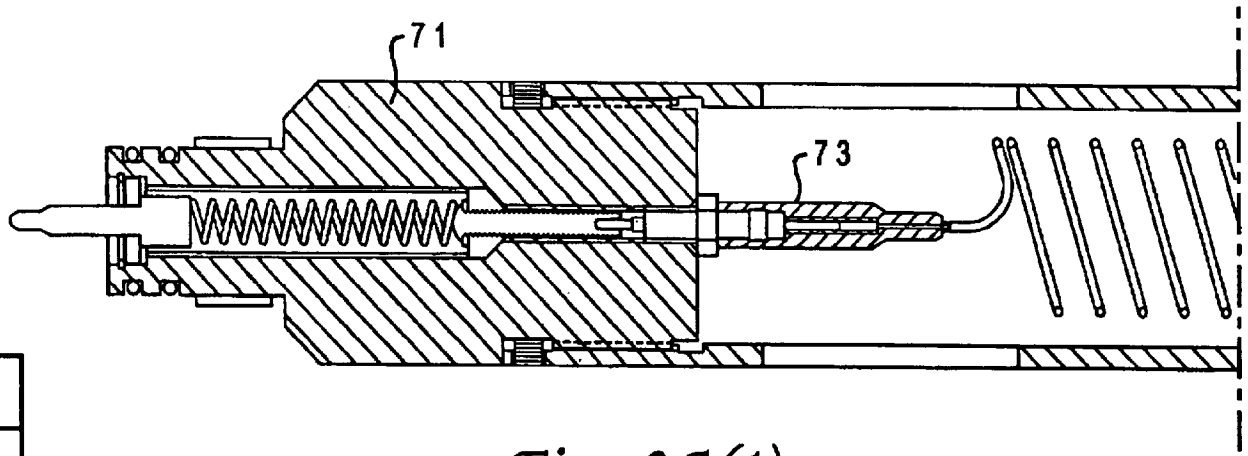
Figure 5A:
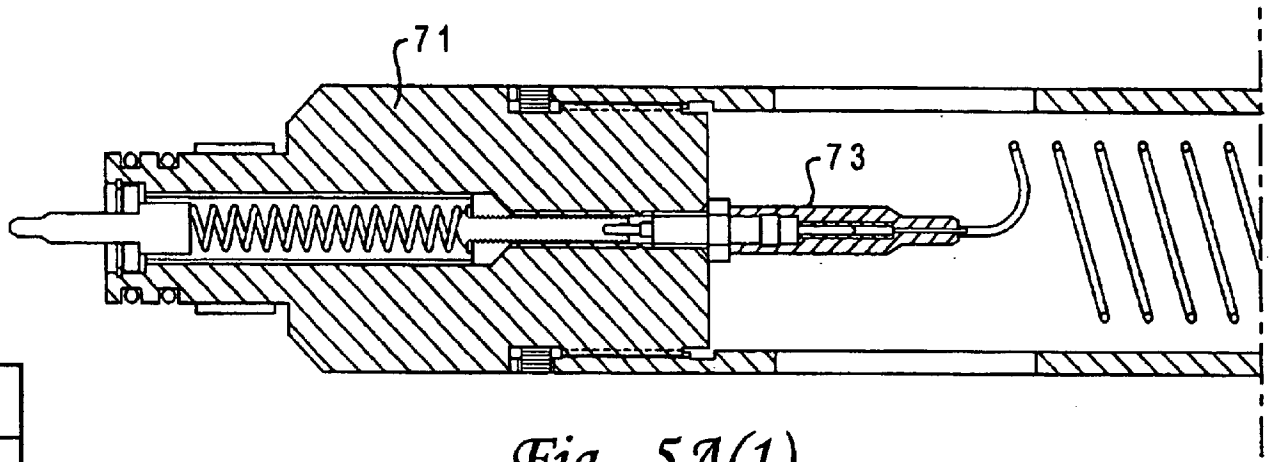
Figure 5A:
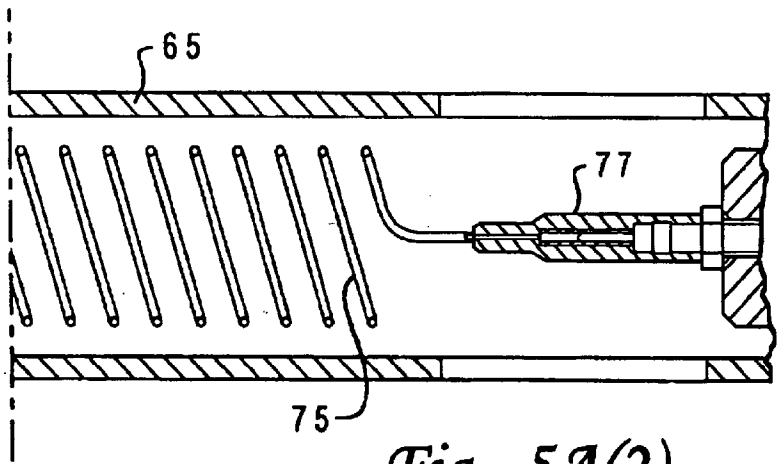
Figure 5B:
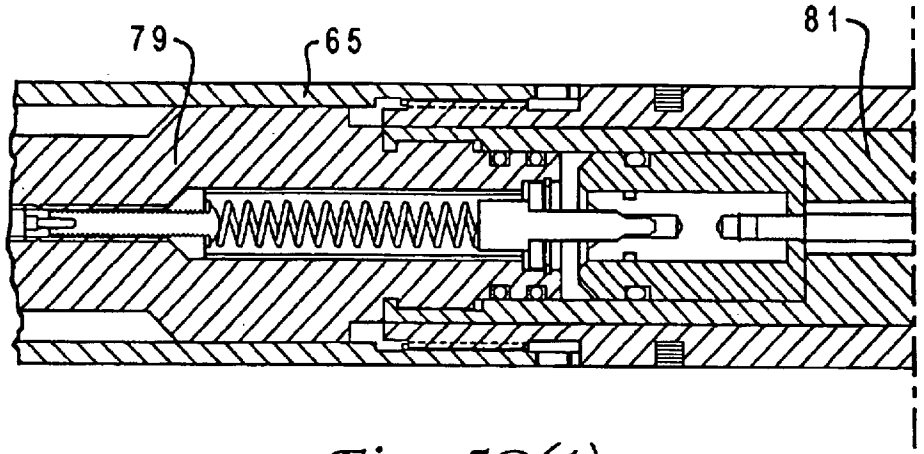
Figure 5B:
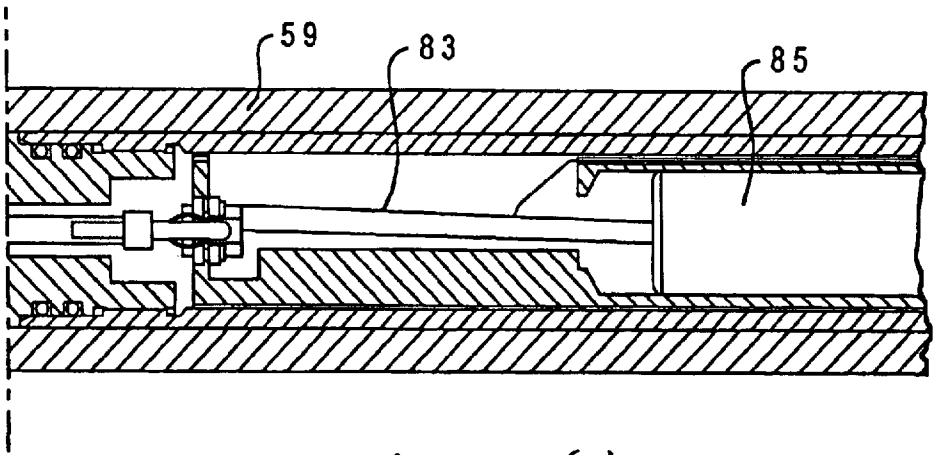
Figure 5C:
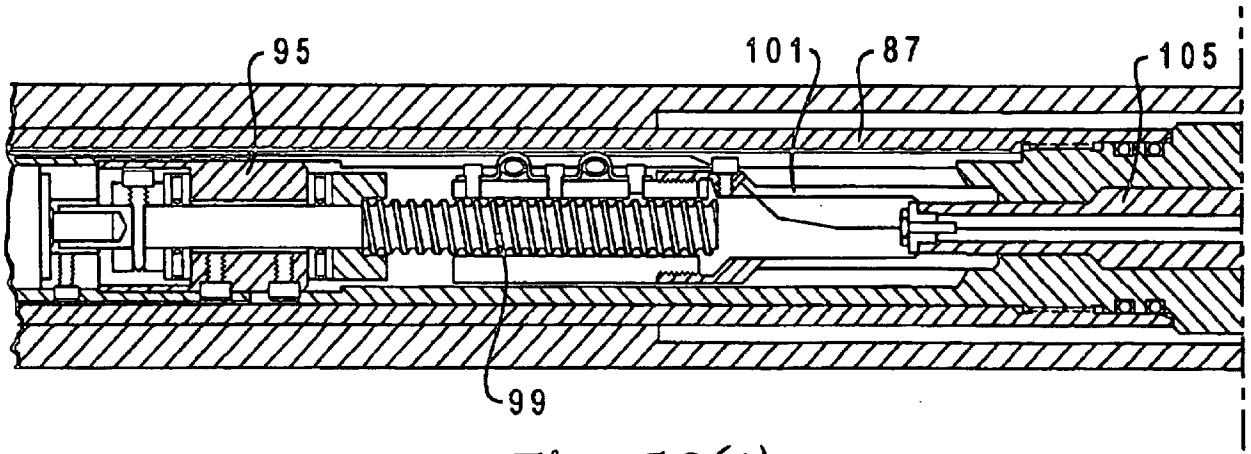
Figure 5C:
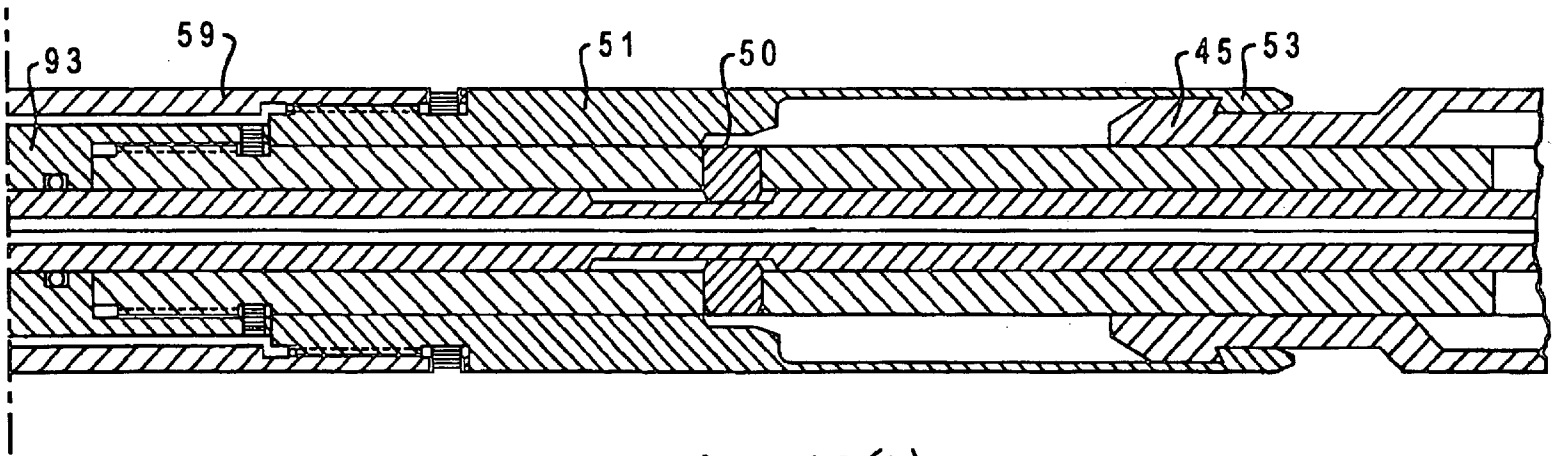
Figure 5D:
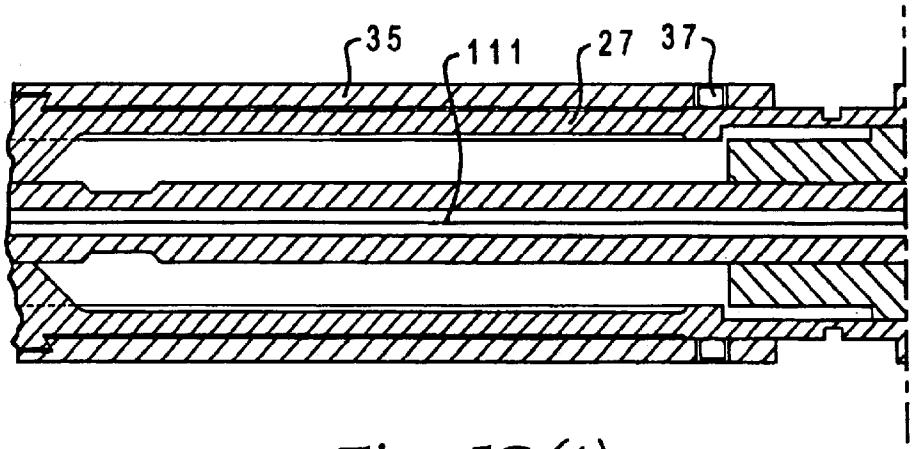
Figure 5D:
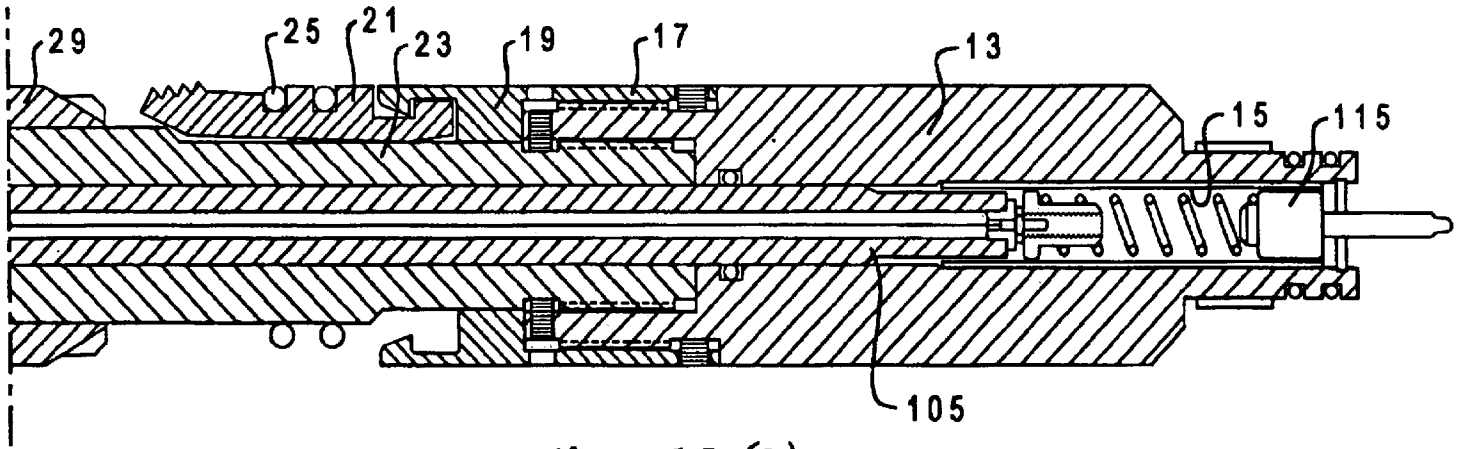

Referring to FIG. 1A, the electro-mechanical wireline assembly as shown in the running-in position. As previously discussed, the perforating gun assembly "T" in FIG. 1D would be attached to the lower adapter 13 and a wireline collar locator assembly would be attached to the top adapter 71. The weight of the tool string is carried through the tool from the lower adapter body 13 (FIG. 1D) which is threaded to the outer mandrel 23 which, in turn, is threaded into the motor frame 93. The bottom extent 117 of the motor frame 93 rests on top of the externally threaded upper extent 55 (FIG. 1C) of the collet housing 51. The collet housing 51 is threadedly connected to the outer motor housing 59. The outer motor housing 59 is threaded into the coiled wire housing 65 which, in turn, is connected to the top adapter 71. The top adapter 71 would be connected through the collar locator (not shown) and wireline to the well surface.

Turning to FIGS. 2A–2D, the wireline assembly would be run into the wellbore to the desired setting depth. An electrical current is then supplied to the motor assembly 85 to turn the screw 99 within the ball nut assembly 97 (FIG. 2C) and move the ball nut assembly 97 axially downward. The ball nut adapter 101, being attached to the ball nut assembly at the upper extent thereof and the inner mandrel 105 at the lower extent thereof transmits the downward axial movement to the inner mandrel. The slip guide 29 (FIG. 2D) is engaged to the inner mandrel 105 by the collet fingers 31. The collet fingers 31 are held in the slots 41 provided on the exterior of the inner mandrel 105 by the collet latch housing 35. As the inner mandrel 105 moves axially downward, the slip guide 29 is forced beneath the gripping slips 21 to move the slips 21 radially outward against the casing/tubing of the wellbore. Contact between the teeth of the gripping slips 21 and the surrounding casing/tubing sets the tool in position. Once the tool is set, tension is pulled on the wireline leading to the well surface in order to verify that the tool is holding.

An electrical current can then be passed down the assembly to the depending perforating gun assembly in order to fire the guns. The well can then be flowed as desired for cleanup.

After the pressure is stabilized, the wireline assembly can be released by sending an electrical current back to the motor assembly 85 to turn the screw 99 in the opposite direction (from setting rotation) to move the slip guide 29, inner mandrell 105, ball nut adapter 101 and ball nut assembly 97 back to the running-in position.

Figure 6:
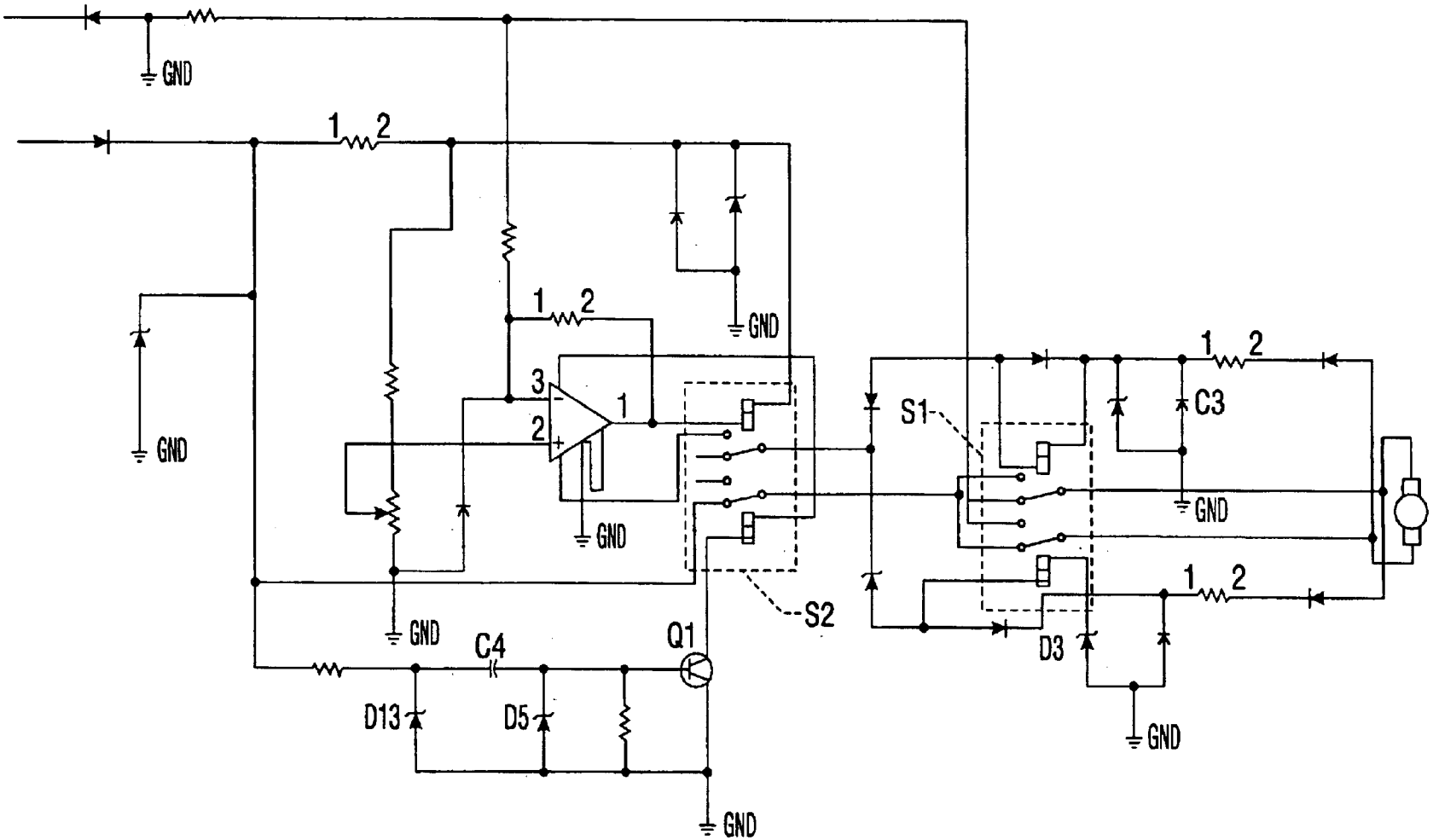
FIG. 6 is an electrical schematic of the electrical circuit and switch means used to power the electric motor assembly to extend and retract the gripping slips which engage the surrounding wellbore.

Referring to FIG. 6, a circuit diagram for a control circuit providing switching control for the motor employed in setting the wireline assembly is depicted. Motor M1 may be any of a number of commercially available motors, such as Globe model 43A10-5. An operational amplifier (op-amp) U1 is employed to control switching of the motor M1. The direction of current through motor M1 is controlled by inductively-switched switching device (relay) S1; inductively-switched switching device S2 controls whether power is transmitted to the motor. Power is supplied to the motor M1 from an input connected to diode D11 and returned through an output connected to diode D12.

Initially, during run-in, power through diode D11 is connected through switching device S2 and switching device S1, which is configured to pass the power in a first polarity, to motor M1. Power out of the motor M1 is connected to the negative feedback loop (resistor R7:1) of op-amp U1 through resistor R8:1, allowing the current drawn by motor M1 to be monitored. When the motor M1 binds (and begins drawing significantly more current) during setting of the wireline assembly, op-amp U1 trips switching device S2 to disconnect the applied input power from motor M1, which in turn causes switching device S1 to trip, reversing the polarity of the connection of motor M1 to the power connections at diodes D11 and D12. Op-amp U1 and switching device S2 may then be reset by disconnecting and reconnecting power to the control circuit. Power is therefore again transmitted to motor M1 from diode D11, but with the opposite polarity as before due to the prior tripping of switching device S1. Subsequent cycling (disconnect/reconnect) of power to the control circuit may be employed to restore switching device S1 to its original position.

It should be noted that only the positive power connection (through diode D11) is employed to directly control motor switching, although the negative power connection through the diode D12 is employed to sense current drawn by motor M1. This allows the negative power connection from the surface to the employed to fire the perforating guns, utilizing circuitry not shown in FIG. 6.

While the tool has been described as being operated with an electric current supplied from a power source at the well surface, it will be appreciated that it could be modified to operate with a power source located downhole on the tool, as well.

If, for some reason, an electrical current cannot be transmitted to the motor assembly 85 after firing the perforating guns, a mechanical back-up release mechanism is utilized.

FIGS. 3A–3D, 4A–4D and 5A–5D illustrate the mechanical release operation. The wireline assembly begins the procedure in the set position illustrated in FIGS. 2A–2D. The retaining dogs (50 in FIG. 2C) prevent any downward movement of the collet housing 51, and in turn, the outer portions of the tool until the tool is in the set position. With the tool in the set position, the recess 119 in the inner mandrel 105 is positioned below the retaining dogs 50, allowing the dogs 50 to move radially inward when the collet housing 51 is moved axially downward. This allows the collet fingers 53 of the collet housing 51 to engage the fishing neck 45 of the collet latch housing 35. An upward pull on the wireline from the well surface then acts to shear the shear pins 37 (FIG. 2D) which initially connect the slip guide 27 to the collet latch housing 35.

After shearing the pins 37 (FIG. 4D), upward movement on the wireline pulls the collet latch housing 51 upwardly to the allow the collets on the slip guide 27 to spring out into the internal recess 39 of the collet latch housing 35. The slip guide 27 is then pulled axially upward from beneath the gripping slips. The gripping slips 21 are then retracted radially inward by means of the biasing force exerted by coiled springs 25 to the running-end position. Once the slips are collapsed, the tools is released and can be retrieved on the wireline from the wellbore. The weight of the tool string is carried out of the hole in the same manner as depicted with respect to the initial running-in position illustrated in FIGS. 1A–1D.

An invention has been provided with several advantages. The electro-mechanical wireline assembly of the invention allows a wireline tool string to be securely anchored in position within a wellbore even during severely underbalanced well conditions. The wireline assembly is simple in design and relatively economical to manufacture and is extremely reliable in operation. Because an electric motor assembly is used to actuate the slip gripping operation, the operator at the well surface knows with certainty when the gripping operation is complete because the motor stalls out. The desired wellbore operations, such as firing of the perforating gun assembly can then be safely carried out. The electric motor assembly also provides a convenient mechanism for the reverse movement of the slip gripping assembly. If, for some reason, the electric motor assembly cannot be reactuated, a simple mechanical release mechanism is provided.

While the invention has been shown in only one of its forms, it is not thus limited but is susceptible to various changes and modifications without departing from the spirit thereof.

What is claimed is:

1. An apparatus for anchoring a tool in a wellbore, comprising:

a housing connected to a perforating gun;

a plurality of slips disposed in said housing, said slips moving radially outward to engage a wellbore wall when actuated by a motor, said perforating gun being thereby anchored in the wellbore; and a mechanical release associated with said slips for retracting said slips to thereby disengage said slips from the wellbore wall; and wherein said mechanical release selectively engages a slip guide configured to move said slips from an extended position to a retracted position.

2. The apparatus of claim 1 wherein a control circuit de-energizes said motor when said slip moves to one of a retracted position and an extended position.

3. The apparatus of claim 1 wherein said motor receives electrical power from one of (i) a wireline from a surface source, and (ii) a downhole power source.

4. The apparatus of claim 1 wherein the direction of rotation of said motor is controlled by cycling electrical power to a control circuit.

5. The apparatus of claim 1 wherein said slips are biased toward said retracted position.

6. An apparatus for anchoring a tool in a wellbore, comprising:

a housing;

a slip disposed in said housing, said slip adopted to move radially between a retracted position and an extended position;

an electric motor coupled to said slip, said motor moving said slip between said retracted position and said extended position when energized;

a control circuit operably coupled to said motor, said control circuit being configured to change a direction of rotation of said motor by selectively changing the polarity of current supplied to said motor, and a mechanical release associated with said slip, said mechanical release configured to move said slip from said extended position to said retracted position, wherein said mechanical release is activated by changing the tension on a wireline connected to said housing.

7. An apparatus for anchoring a tool in a wellbore, comprising:

a housing;

a slip disposed in said housing, said slip adapted to move radially between a retracted position and an extended position;

an electric motor coupled to said slip, said motor moving said slip between said retracted position and said extended position when energized;

a mechanical release for retracting said slip from said extended position to said retracted position;

a wiring assembly disposed in said housing and coupled to a firing head of a perforating gun, said wiring assembly electrically coupling the tool to a power supply; and wherein said wiring assembly includes a coiled wire for allowing axial movement of the apparatus.

8. The apparatus of claim 7 wherein said power supply is located at one of (i) a surface location, and (ii) a downhole location.

9. The apparatus of claim 7 wherein said wiring assembly is in electrical communication with a control circuit associated with said motor.

10. A method for anchoring a tool in a wellbore, comprising:

disposing a slip on a housing, the slip being adapted to move radially between a retracted position and an extended position;

coupling an electric motor to the slip;

moving the slip between the retracted position and the extended position by energizing the motor;

controlling the direction of rotation of the motor with a control circuit, the circuit being configured to selectively change the polarity of the current supplied to the motor;

connecting a perforating gun to the housing;

energizing the motor only when supplying to the control circuit a current having a first polarity; and firing the perforating gun by supplying an electrical current having a second polarity different from the first polarity;

wherein the control circuit cuts current to the motor when the slip moves to one of the retracted position and the extended position.

11. The method of claim 10 wherein the control circuit is configured to selectively change the polarity of current supplied to the motor.

12. The method of claim 10 further comprising changing the direction of rotation of the motor by cycling the supply of electrical power to the control circuit.

13. A method for anchoring a tool in a wellbore, comprising:

disposing a slip on a housing, the slip being adapted to move radially between a retracted position and an extended position;

coupling an electric motor to the slip;

moving the slip between the retracted position and the extended position by energizing the motor; and controlling the direction of rotation of the motor with a control circuit, the circuit being configured to selectively change the polarity of the current supplied to the motor, wherein the control circuit is configured to detect an over current caused by the motor.

14. A method for anchoring a tool in a wellbore, comprising:

providing a plurality of slips on the tool;

extending the slips radially outward into engagement with a wellbore wall using a motor;

energizing the tool while the tool in anchored in the wellbore; and mechanically retracting the slips from an extended position to a retracted position with a slip guide configured to move said slips from an extended position to a retracted position whereby the slips disengage from the wellbore wall.

15. The method of claim 14 further comprising biasing the slip toward the retracted position.

16. A method for anchoring a tool in a wellbore, comprising:

disposing a slip on a housing, the slip being adapted to move radially between a retracted position and an extended position;

coupling an electric motor to the slip;

moving the slip between the retracted position and the extended position by energizing the motor;

controlling the direction of rotation of the motor with a control circuit, the circuit being configured to selectively change the polarity of the current supplied to the motor; and changing the tension on a wireline connected to the housing to activate a mechanical release that retracts the slip.

* * * * *